United States Patent [19]

Briner et al.

[11] Patent Number: 4,669,258

[45] Date of Patent: Jun. 2, 1987

[54] METHOD OF REMOVING A BLOCKAGE IN A FALSE TWIST SPINNING UNIT

[75] Inventors: Emil Briner, Winterthur; Urs Keller, Seuzach, both of Switzerland

[73] Assignee: Rieter Machine Works Ltd., Winterthur, Switzerland

[21] Appl. No.: 725,768

[22] Filed: Apr. 22, 1985

[30] Foreign Application Priority Data

Apr. 25, 1984 [CH] Switzerland ..... 2027/84

[51] Int. Cl.[4] ..... D01H 11/00; D01H 5/28

[52] U.S. Cl. ..... 57/304; 57/261; 57/302; 57/328

[58] Field of Search ..... 57/261, 263, 328, 302, 57/301, 304, 305

[56] References Cited

U.S. PATENT DOCUMENTS

| | | | |
|---|---|---|---|
| 4,107,911 | 8/1978 | Yamana et al. | 57/304 |
| 4,135,354 | 1/1979 | Stahlecker | 57/302 |
| 4,517,794 | 5/1985 | Sakai et al. | 57/261 X |
| 4,543,776 | 10/1985 | Seiki et al. | 57/328 X |
| 4,550,560 | 11/1985 | Tanaka et al. | 57/261 |

FOREIGN PATENT DOCUMENTS

| | | | |
|---|---|---|---|
| 0019595 | 11/1980 | European Pat. Off. . | |
| 0107339 | 5/1984 | European Pat. Off. . | |
| 3238986 | 7/1983 | Fed. Rep. of Germany . | |
| 3235769 | 7/1983 | Fed. Rep. of Germany . | |
| 2368557 | 5/1978 | France . | |
| 35033 | 4/1978 | Japan | 57/261 |

*Primary Examiner*—John Petrakes

*Attorney, Agent, or Firm*—Werner W. Kleeman

[57] ABSTRACT

In a false twist spinning unit a fiber sliver is removed from a fiber sliver can and fed into a drafting mechanism. The fiber aggregation delivered by the drafting mechanism is received by a suction portion of a spinning unit and is passed to a twist-imparting element which produces a spun yarn. The spun yarn is withdrawn by a roller pair and passes via a yarn monitoring device to a winding unit. The suction pressure required for the suction portion is produced by a suction device. In the event of blockage of the suction portion, a cleaning element or device is activated. After cleaning of the suction portion is completed, spinning is restarted.

5 Claims, 6 Drawing Figures

METHOD OF REMOVING A BLOCKAGE IN A FALSE TWIST SPINNING UNIT

BACKGROUND OF THE INVENTION

The present invention relates to a new and improved method of removing a blockage in a false twist spinning unit.

In its more particular aspects the method of the present invention contemplates removal of a blockage in a false twist spinning unit, in particular in a suction drawing-in portion or suction portion forming part of the false twist spinning unit, wherein a yarn monitoring device is arranged downstream of the false twist spinning unit with respect to the direction of travel or movement of the yarn or thread or the like.

A number of false twist spinning units are already known to the art in which at each spinning position a fiber sliver delivered from a sliver can is drafted in a drafting mechanism, spun into a yarn in a false twist spinning unit and thereafter the produced yarn is wound up in a winding unit.

Between the false twist spinning unit and the winding unit there is usually arranged a yarn monitoring device which indicates either the presence of so-called thick places in the yarn or the absence of the yarn.

Upon the occurrence of these so-called thick places, yarn production is immediately stopped and the yarn portion or section having the thick place is removed. Thereafter, spinning is restarted.

The entire operation can either be carried out manually or by means of a controlled device.

Upon indication of the absence of the yarn, the yarn production is also immediately stopped in order to establish the reason for the absence of the yarn.

When there is employed a pneumatic suction drawing-in portion or suction portion for the purpose of receiving the fiber aggregation delivered by the drafting mechanism, then, in many cases, the danger exists that a blockage forms in the suction portion. This blockage may arise, for example, if there are present in the fiber aggregation foreign bodies or fiber tufts which do not pass through an orifice or constriction terminating the suction portion.

In such cases fiber material present in the suction portion must be manually cleared with the aid of an appropriate tool in order to thereafter carry out restarting of the spinning operation.

This manual clearing of such blockage has the disadvantage, however, that there exists the danger of damage to the suction portion by the attendant or operator, so that blockages, for example due to retention of fibers on rough surfaces, tend to occur more frequently than before. Furthermore, manual removal of the disturbance is labor-intensive and is associated with the undesirable need to wait for the attendant.

SUMMARY OF THE INVENTION

Therefore, with the foregoing in mind it is a primary object of the present invention to provide an improved method of removing a blockage in a false twist spinning unit in a manner not afflicted with the aforementioned shortcomings and drawbacks of the prior art proposals.

It is another important object of the present invention to devise an improved method of avoiding or at least minimizing blockage in a false twist spinning unit by avoiding the aforedescribed damage and which enables again placing the spinning position into an operational condition in a speedy and rational manner.

Now in order to achieve the aforementioned objects and others which will become more readily apparent as the description proceeds, the method of the present development is manifested by the features that there are accomplished the following automatically controlled steps:

(a) sensing a blockage existing in the false twist spinning unit,
(b) opening the false twist spinning unit,
(c) inserting a cleaning device into the suction portion in a direction corresponding to the direction of yarn or thread travel and thereby removing the blockage,
(d) removal of the cleaning device,
(e) closing the false twist spinning unit, and
(f) restarting spinning.

According to a further embodiment of the present invention there can be carried out the method steps of:

(a) sensing a blockage existing in the false twist spinning unit,
(b) opening the false twist spinning unit,
(c) removing the suction portion,
(d) inserting a replacement suction portion in an operational condition,
(e) closing the false twist spinning unit, and
(f) restarting spinning.

According to still further embodiment of the present invention there can be accomplished the following method steps:

(a) sensing a blockage existing in the false twist spinning unit,
(b) opening the false twist spinning unit,
(c) moving the suction portion out of the false twist spinning unit into a predetermined cleaning position,
(d) cleaning the suction portion,
(e) checking the suction portion,
(f) replacing the suction portion in a predetermined operating position in the false twist spinning unit, and
(g) restarting spinning.

Some of the more notable advantages achieved by the present invention substantially reside in the fact that the suction portions are cleaned with certainty and without damage, and furthermore, the spinning position is again placed into its operating condition or state in the shortest amount of time.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
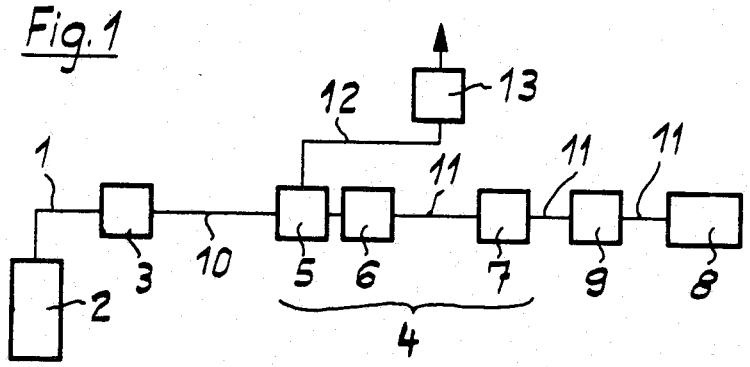
FIG. 1 shows a schematic representation of a spinning process.

Describing how the drawings, it will be understood that in a so-called false twist spinning method a fiber sliver 1 is removed from a fiber sliver can 2 and fed to a suitable drafting mechanism 3.

Arranged after the drafting mechanism 3, viewed with respect to the direction of travel of the fiber sliver 1, is a so-called false twist spinning unit 4 which comprises a suction drawing-in portion or suction portion 5, one or more twist-imparting elements 6 adjoining the suction portion 5 and a withdrawal roll pair 7. In the following description, only the single twist-imparting element 6 is discussed, but it is to be specifically understood that such is equally representative of an arrangement constituting a plurality of such twist-imparting elements.

A yarn monitoring device 9 is provided at the yarn travel path or along the yarn direction of travel between the withdrawal roll pair 7 and a wind-up unit or winder 8.

The fiber aggregation 10 delivered by the drafting mechanism 3 is received by the suction portion 5 and delivered to the twist-imparting element or twisting element 6. A spun yarn 11 is formed by the operation of the twist-imparting element 6. This spun yarn 11 is received by the withdrawal roll pair 7 and is passed via the yarn monitoring device 9 to the yarn wind-up unit 8.

The suction portion 5 is connected by means of a connection or connecting line 12 to a suitable suction device 13. The suction portion 5 can, however, operate without the suction device 13 provided that the subsequently arranged twist-imparting element 6 is a pneumatic twist-imparting element possessing a suction effect which is coupled directly to the suction portion 5.

The entire arrangement, that is from the fiber sliver can 2 to the yarn wind-up unit 8, is called a spinning position.

Figure 2:
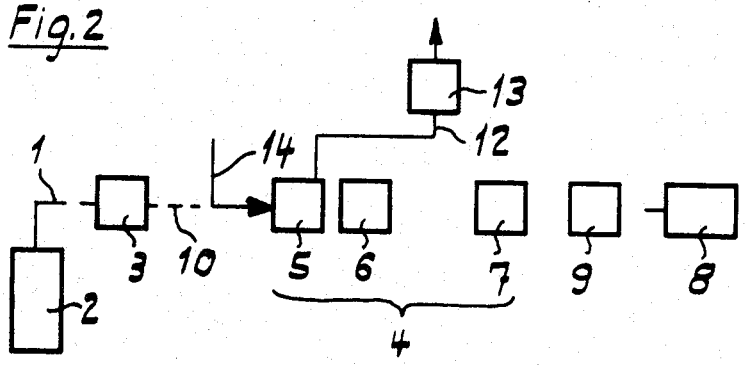
FIG. 2 shows the spinning process of FIG. 1 in a cleaning phase.

FIG. 2 shows the condition of a cleaning phase in which the yarn production at the spinning position is interrupted as a result of a blockage in the suction portion 5. After the yarn end has left the yarn monitoring device 9, the spinning position is caused to stop, or else the fiber sliver infeed is interrupted.

In order to deal with this undesirable condition or state, the suction portion 5 and its immediate surroundings are freed of the blockage by means of a suitable cleaning element or device 14 (which has been conveniently schematically illustrated as an arrow to simplify the illustration of the drawings). Thereafter, spinning is re-started.

Depending upon the system or design of the suction portion 5, the suction action prevailing in its infeed portion also can be maintained in operation during the cleaning process, that is the suction action does not have to be interrupted during cleaning of the suction portion 5.

If the restart of spinning is a failure, then the aforedescribed cleaning operation can be repeated by means of the cleaning element or device 14.

After a number of unsuccessful attempts at restart of spinning have occurred, the spinning position is left inoperable and then must be checked by the operating personnel.

Figure 3:
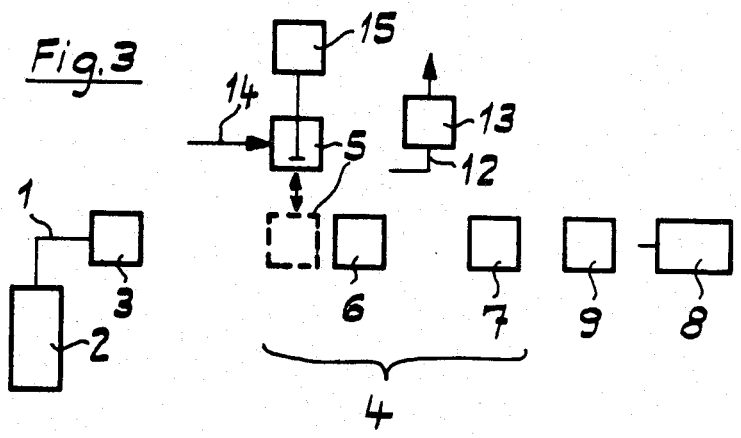
FIG. 3 shows a schematic representation of a modification of the process of FIG. 1.

FIG. 3 shows a modified procedure wherein for the cleaning of the suction portion 5 the latter is lifted or pivoted out of the operational position (indicated with broken lines) into a cleaning position (indicated in full lines).

The lifting or the pivoting out of and the return of such suction portion 5 into the operating position is effected either manually or by any suitable removal or displacement device 15 which is associated with each spinning position or is associated with a travelling cleaning robot.

This variant embodiment offers the advantage that the cleaning process does not have to be carried out within the operating arrangement of the elements.

After re-positioning of the suction portion 5 in the operating position, the procedure for re-starting spinning is carried out.

Also with this variant technique the cleaning operation can be repeated if the spinning re-start procedure proves unsuccessful.

Depending upon the cleaning device or element which is actually used, the connection 12 to the suction device 13 can be interrupted or not, as deemed appropriate, for cleaning of the suction portion 5.

Figure 4:
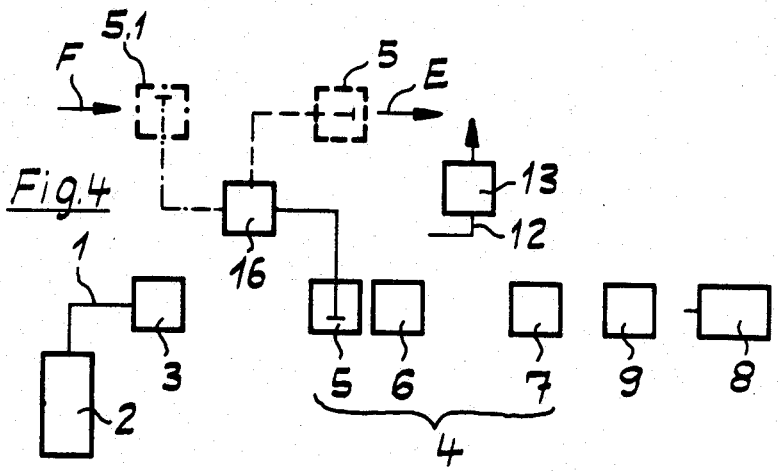
FIG. 4 shows a schematic representation of a further process in the cleaning phase.

FIG. 4 shows a further variant method of the present invention in which, upon blockage of the suction portion 5, the latter is moved by means of a suitable removal or displacement device 16 into an ejection position (illustrated with broken lines) for exchange of the suction portion 5. In this broken line depicted ejection position the suction portion 5 is removed from the spinning position as indicated diagrammatically with the arrow E.

Thereafter, in the same position, or as indicated in FIG. 4 with chain-dotted lines in another position, a replacement suction portion 5.1 which has previously been placed in an operationally ready condition or state is grasped, as indicated diagrammatically with the arrow F, and is then brought into the operating position (indicated with full lines), so that the procedure for restarting spinning can be effected.

The removal of the blocked suction portion 5 and the grasping of the operationally ready suction portion 5.1 can be carried out manually or automatically by means of the aforementioned removal or displacement device 16.

Operational and blocked suction portions can be stored in a compartmented magazine or in any other suitable storage area.

After the aforedescribed removal of the suction portion 5 this part can be cleaned in a separate operation and placed in an operationally ready or stand-by position from where this cleaned suction portion can be again extracted at the appropriate time by accomplishing the movement schematically indicated with the arrow F.

Figure 5:
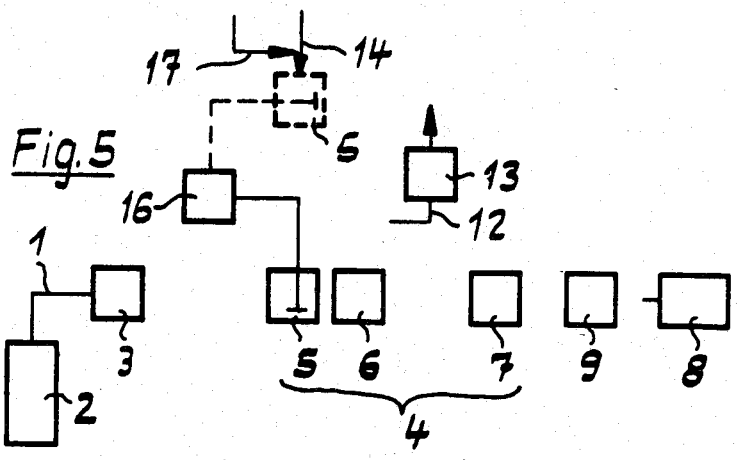
FIG. 5 shows schematically a further process also illustrated in the cleaning phase.
Figure 6:
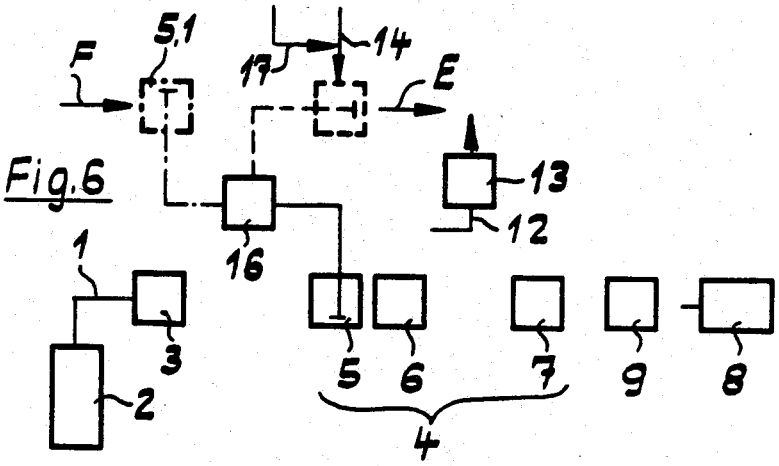
FIG. 6 shows a modification of the process of FIG. 5.

FIGS. 5 and 6 show a combination of method steps as previously discussed with respect to the embodiments of FIGS. 3 and 4.

In this method, particularly as depicted in FIG. 5, the suction portion 5 is cleaned while, following removal by the removal or displacement device 16, it is located in its removed or extracted position (indicated with broken lines) by means of the cleaning element or device 14. This cleaned suction portion 5 is thereafter checked to determine whether or not it possesses the requisite degree of cleanliness by a monitoring element 17, and thereafter if this is found to be the case such properly cleaned suction portion 5 is reset in the operating position (indicated in full lines), so that the procedure for restarting spinning can thereafter be carried out.

The method according to FIG. 6 includes the additional step that after unsuccessful cleaning of the suction portion 5 the latter, as indicated by the arrow E, is removed and thereafter a new operational suction portion 5.1 is grasped, as indicated by the arrow F, and is moved into the operational position (indicated in full lines).

Thereafter, the procedure for restarting spinning can be carried out again.

It is to be clearly understood that the just described technique of checking the suction portion 5, after its cleaning by the cleaning element or device 14, can also be used for the cleaning processes previously described with reference to FIGS. 2 and 3.

It is also to be understood that in the methods described with reference to FIGS. 5 and 6 the connection 12 between the suction portion 5 and the suction device 13 can be interrupted during cleaning of the suction portion 5.

Furthermore, the twist-imparting element or twisting element 6 can be a pneumatic or a mechanical twisting element. During restart of spinning, when employing a mechanical twisting element, those possible steps conventionally employed for taking up fiber material delivered by the suction portion to the twisting element do not form part of this invention and since such steps are unimportant thereto they will not be here further considered.

While there are shown and described present preferred embodiments of the invention, it is to be distinctly understood that the invention is not limited thereto, but may be otherwise variously embodied and practiced within the scope of the following claims.

Accordingly, what we claim is:

1. A method of removing a blockage in a false twist spinning unit for producing a yarn, in particular in a suction portion forming part of the false twist spinning unit, in combination with a yarn monitoring device, arranged downstream of the false twist spinning unit as viewed with respect to a predetermined direction of movement of the yarn, comprising the steps of:

(a) sensing a blockage existing in the false twist spinning unit;

(b) opening the false twist spinning unit;

(c) removing the suction portion;

(d) inserting a replacement suction portion in an operational position;

(e) closing the false twist spinning unit; and (f) restarting spinning.

2. The method as defined in claim 1, further including the steps of:

after the removal of the suction portion cleaning the removed suction portion while located in a predetermined cleaning position, and thereafter moving the cleaned suction portion into a predetermined stand-by position.

3. The method as defined in claim 1, further including the step of:

said steps of removing the suction portion and inserting said replacement suction portion entail removing said suction portion and inserting said replacement suction portion into said operational position using a displacement device; and automatically controlling the operation of said displacement device.

4. A method of removing a blockage in a false twist spinning unit for producing a yarn, in particular in a suction portion forming part of the false twist spinning unit, in combination with a yarn monitoring device arranged downstream of the false twist spinning unit as viewed with respect to a predetermined direction of movement of the yarn, comprising the steps of:

(a) sensing a blockage existing in the false twist spinning unit;

(b) opening the false twist spinning unit;

(c) moving the suction portion into a predetermined cleaning position;

(d) cleaning the suction portion;

(e) checking the suction portion;

(f) placing the suction portion into a predetermined operating position in the false twist spinning unit;

(g) restarting spinning; and in the event of inadequate cleaning of the suction portion removing the suction portion and replacing said removed suction portion by a replacement suction portion which is in an operationally ready condition.

5. The method as defined in claim 4, further including the step of:

said steps of removing the suction portion and replacing the removed suction portion by a replacement suction portion entail removing said suction portion and replacing said removed suction portion by said replacement suction portion using a displacement device; and automatically controlling the operation of said displacement device.

* * * * *